United States Patent [19]

Pungas

[11] 4,280,088

[45] Jul. 21, 1981

[54] REFERENCE VOLTAGE SOURCE

[76] Inventor: Toom A. Pungas, bulvar Sypruse, 219, kv. 3, Tallin, U.S.S.R.

[21] Appl. No.: 954,576

[22] Filed: Oct. 25, 1978

[30] Foreign Application Priority Data

Nov. 1, 1977 [SU] U.S.S.R. ..... 2531855

[51] Int. Cl.[3] ..... G05F 3/04

[52] U.S. Cl. ..... 323/304

[58] Field of Search ..... 307/296 R, 296 A, 318; 323/9, 23, 25, 40, 75 F

[56] References Cited

U.S. PATENT DOCUMENTS 3,634,751 1/1972 Miller ..... 323/75 F 3,697,862 10/1972 Taylor ..... 323/9

FOREIGN PATENT DOCUMENTS 577521 10/1977 U.S.S.R. ..... 323/25

OTHER PUBLICATIONS

IBM Technical Disclosure Bulletin, vol. 13, No. 10, pp. 2944–2945, Mar. 1971.

Electronic Engineering, pp. 23, 25, Dec. 1974.

*Primary Examiner*—William H. Beha, Jr.

*Attorney, Agent, or Firm*—Steinberg & Raskin

[57] ABSTRACT

A reference voltage source comprises a bridge network including two zener diodes and two resistors, two operational amplifiers and two switches whose inputs receive a control voltage from the source and whose outputs are coupled to non-inverting inputs of respective operational amplifiers. The first operational amplifier has its inverting input and its output coupled respectively to the anode and cathode of the first zener diode, while the second operational amplifier has its inverting input and its output coupled respectively to the cathode and anode of the second zener.

4 Claims, 6 Drawing Figures

REFERENCE VOLTAGE SOURCE

FIELD OF THE INVENTION

The present invention relates to voltage sources, and more particularly to reference voltage sources.

The invention is suitable for use with automatic measuring systems which require sources providing rectangular calibrating signals of good time stability.

Known in the art is a reference voltage source comprising a bridge network including two zener diodes in two opposite arms of the bridge network and two resistors in two other arms of a bridge network, and also comprising two operational amplifiers connected alternately to the output terminal of the reference voltage source (cf. the USSR Inventor's Certificate No. 445,037, cl. G05F, 1/56). In the known reference voltage source, the first operational amplifier has an inverting input and an output coupled respectively to the anode and cathode of one zener diode, while the second operational amplifier has an inverting input and an output coupled respectively to the cathode and anode of the other zener diode.

The known source is disadvantageous in that the d.c. component of the output voltage and the amplitude of a rectangular a.c. voltage cannot be controlled simultaneously.

SUMMARY OF THE INVENTION

An object of the invention is to provide for a wider range of functional capabilities of a reference voltage source.

There is provided a reference voltage source comprising a bridge network having two opposite arms each including a respective zener diode and having two other arms each including a respective resistor, two operational amplifiers connected alternately to an output terminal of the reference voltage source, a first one of the operational amplifiers having an inverting input and an output coupled respectively to the anode and cathode of one zener diode, a second one of the operational amplifiers having an inverting input and an output coupled respectively to the cathode and anode of the other zener diode, which reference voltage source comprises, according to the invention, two switches coupled respectively to non-inverting inputs of the operational amplifiers and having their inputs supplied with a control voltage from the input terminal of the reference voltage source.

Advantageously, the switches are coupled to the output terminal of the reference voltage source via respective series arrangements each including a resistor and a capacitor.

Preferably, the reference voltage source comprises an integrating feedback means built around an operational amplifier which has its inverting input coupled to the output terminal of the reference voltage source, its non-inverting input receiving a control voltage from the reference voltage source, and its output coupled to the outputs of the two switches.

The reference voltage source of the invention therefore provides for a wider range of functional capabilities and can provide an electrical voltage for controlling the value of the d.c. component of a rectangular output voltage without changing the peak-to-peak value (the total value of positive and negative amplitudes) of the a.c. component of the output voltage.

DESCRIPTION OF THE DRAWINGS

The invention will now be described, by way of examples, with reference to the accompanying drawings, in which.

DESCRIPTION OF THE INVENTION

Figure 1:
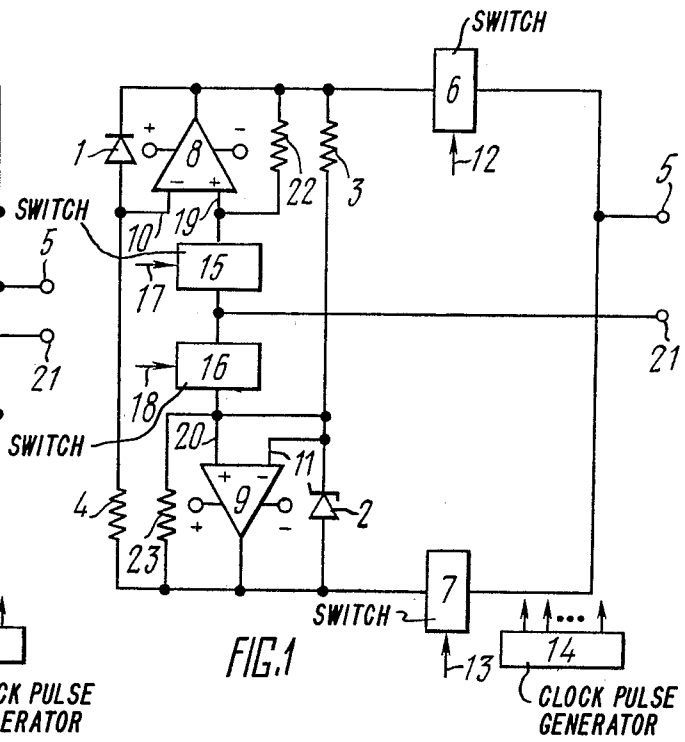
FIG. 1 is a circuit diagram of a reference voltage source, according to the invention.

The reference voltage source of the invention (FIG. 1) comprises a bridge network including two zener diodes 1, 2 inserted respectively in two opposite arms of the bridge network and two resistors 3, 4 in two other arms of the network. Operational amplifiers 8, 9 are coupled alternately to an output terminal 5 of the reference voltage source via respective first and second switches 6, 7. The operational amplifier 8 has an inverting input 10 and an output coupled respectively to the anode and cathode of the zener diode 1, whereas the operational amplifier 9 has an inverting input 11 and an output coupled respectively to the cathode and anode of the zener diode 2. Control inputs of the 12 and 13 of the switches 6 and 7, respectively, are coupled to respective outputs of a clock pulse generator 14.

Third and fourth switches 15 and 16 are connected in series and have control inputs 17, 18, respectively coupled to the clock pulse generator 14. The outputs of the switches 15, 16 are coupled respectively to non-inverting inputs 19, 20 of the operational amplifiers 8 and 9, respectively, and the outputs of said switches are coupled to an output terminal 5 of the reference voltage source. A control voltage from the source is applied to an input terminal 21 of the reference voltage source.

Each of the switches 6, 7, 15 and 16 may comprise a complementary MOS switch of the type described in Analog-Digital Conversion Handbook, Analog Devices, Inc., Norwood, Mass. 02062, 1976, pages III-49, III-50, FIG. 4, or an analog switch, type AH0015D of National Semiconductor, described in National Linear Data Book, National Semiconductor, 1976, pages 6-1, 6-2.

Resistors 22, 23 are coupled between the non-inverting inputs 19, 20 and the outputs of the corresponding operational amplifiers 8 and 9, respectively.

Figure 2:
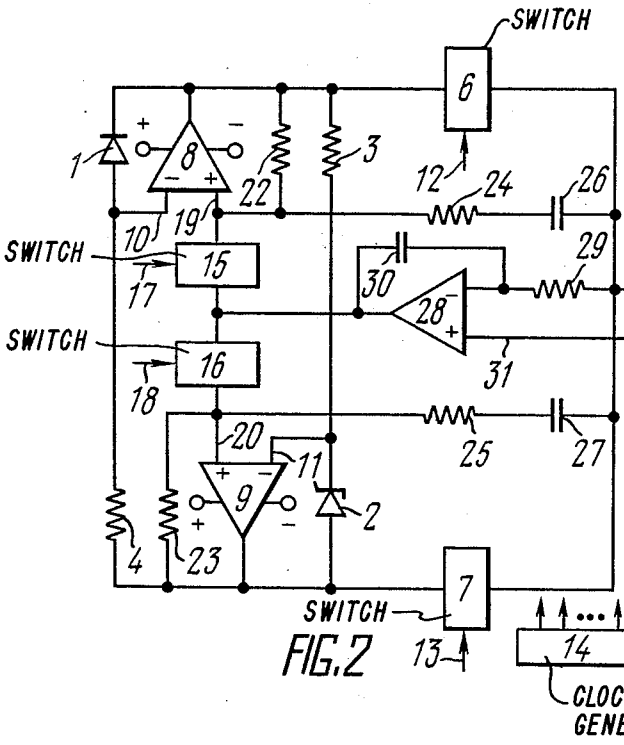
FIG. 2 is a circuit diagram of a reference voltage source with an integrating feedback means, according to the invention.
Figure 3A:
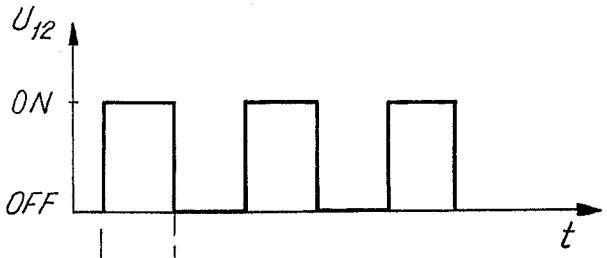
FIG. 3*a* is a graphic presentation of the voltage at the control input 12 for controlling the switch 6.
Figure 3B:
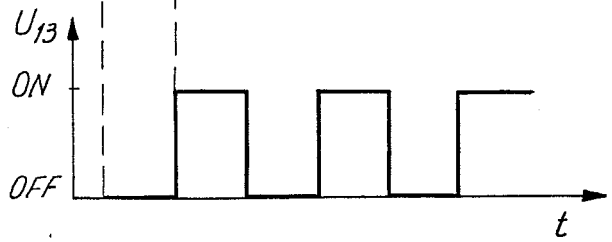
FIG. 3*b* is a graphical presentation of the voltage at the control input 13 for controlling the switch 7.
Figure 3C:
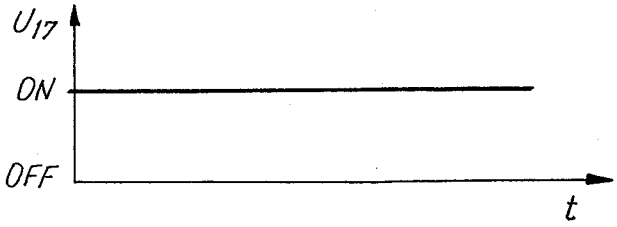
FIG. 3*c* is a graphical presentation of the voltage at the control input 17 for controlling the switch 15.
Figure 3D:
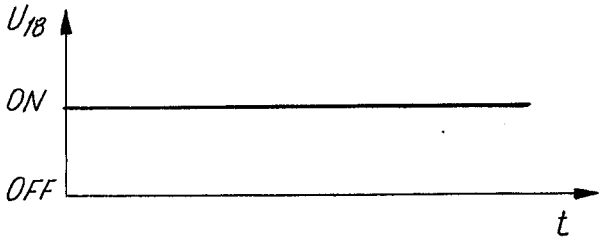
FIG. 3*d* is a graphical presentation of the voltage at the control input 18 for controlling the switch 16.

The switches 15, 16 are coupled, via respective series arrangements of RC-circuits, having a resistor 24 (FIG. 2) and a capacitor 26 and a resistor 25 and a capacitor 27, respectively, to the output terminal of the reference voltage source.

The reference voltage source can be provided with an integrating feedback means which includes, in the given embodiment, an operational amplifier 28, an input resistor 29 and a capacitor 30. The operational amplifier 28 has a non-inverting input 31 coupled to the input terminal 21 and has an output coupled to the inputs of the switches 15, 16.

The reference voltage source of the invention operates in the following manner. The operational amplifiers 8, 9 are fed from a bipolar supply means with the result that their output voltages can be adjusted in wide limits. In a stationary mode, the output of the operational amplifier 8 provides a positive stabilized voltage, while the output of the operational amplifier 9 provides a negative stabilized voltage. Both voltages offer an extremely high stability, since the working current flowing through the zener diodes 1, 2 is stabilized. The working current of the zener diode 1 is determined by a ratio of a voltage drop sum for the zener diode 2, switches 15, 16 and resistor 4, whereas the working current of the zener diode 2 is determined by a ratio of a voltage drop sum for the zener diode 1, said switches and resistor 3. The working current of the switch 15 is determined by a ratio of a voltage drop for the zener diode 1 and resistor 22, while the working current of the switch 16 is determined by a ratio of a voltage drop for the zener diode 2 and resistor 23.

The switches 15, 16 are constantly held in "on" condition since the resistors 22, 23 provide for a d.c. current to flow through said switches. The value of the current is equal to the output current flowing through the switches 6, 7. The switches 6 and 7 operate alternately to connect the outputs of the operational amplifiers 8 and 9 to the output terminal 5.

The output terminal 5 provides a rectangular a.c. voltage whose peak-to-peak value (the total value of positive and negative amplitudes) is given by $U\ U_2 + U_{16} + U_{15} - U_1 - U_6 - U_7 \approx U_2 + U_1$ where $U_1$, $U_2$, $U_6$, $U_7$, $U_{15}$, $U_{16}$ are the voltage drops for corresponding components 1, 2, 6, 7, 15, 16 of the reference voltage source.

In environmental conditions, for example, temperatures tend to vary. This causes the voltage drops for the switches 6, 7 and switches 15, 16, which are small compared to the output voltage, to vary by the same value. However, the peak-to-peak value of the output voltage does not change in this case.

In the case where the output voltage pulses of either polarity have different amplitudes and equal lengths, or where these pulses have equal amplitudes and different lengths, the d.c. component of the output voltage is biased.

A condition in which the d.c. component differs from the control voltage at the output terminal 5 by some amount causes a current to flow through the resistor 29, which current is integrated and results in a biasing of the potentials across the connection point of the 15, 16, across the inverting inputs 10, 11 of the operational amplifiers 8, 9, respectively, and then across the outputs of said operational amplifiers. This results in the d.c. component provided by the output terminal 5 assuming the required value.

In the case where an induction-type divider is fed from a common bus of the reference voltage source, the terminal 21 is coupled to the common bus and the induction-type divider is coupled directly to the output terminal 5, so that the accuracy of the divider is not impaired under idle direct current conditions.

The RC-circuits provide for the establishment of a positive a.c. voltage feedback established between the output of the reference voltage source and the non-inverting inputs 19, 20 of the operational amplifiers 8, 9, respectively and for an increase in the rate with which the output voltage of the source is changed during the switching process.

The reference voltage source is advantageous in that its output voltage can be measured under direct current conditions and the effective and mean values of the absolute magnitude of the produced a.c. voltage therefore can be determined with the accuracy of conversion. To this end, the connection point of the energized switches 15, 16 is grounded first with the switch 6 in "on" condition and the switch 7 in "off" condition and then with the switch 7 in "on" condition and the switch 6 in "off" condition.

The rectangular a.c. voltage can be transferred to a consumer without distortion, since the reference voltage source is connected to it in a matched condition where no coupling capacitor is required.

It will be appreciated that although the reference voltage source of the present invention has been described as a particular source with particular constants, other equivalent sources may be constructed which embody the concepts of the invention.

What is claimed is:

1. A reference voltage source, comprising a bridge network having two opposite arms each including a respective zener diode, and two other arms each including a respective resistor;

two operational amplifiers each having an inverting input, a non-inverting input, and an output, the inverting input of said first operational amplifier being coupled to the anode of a first one of said two zener diodes, the inverting input of said second operational amplifier being coupled to the cathode of said second zener diode, the output of said first operational amplifier being coupled to the cathode of said first zener diode, and the output of said second operational amplifier being coupled to the anode of said second zener diode;

two switches each having an input and an output, a control voltage from the reference voltage source being applied to the inputs of said switches, and the outputs of said switches being coupled respectively to the non-inverting inputs of said operational amplifiers; and an output terminal to which the outputs of said operational amplifiers are alternately connected.

2. A reference voltage source as claimed in claim 1, further comprising two circuits each having a resistor and a capacitor connected in series and each connected to the output terminal of the reference voltage source and to the output of a corresponding one of said switches.

3. A reference voltage source as claimed in claim 1, further comprising integrating feedback means including a third operational amplifier having an inverting input coupled to the output terminal of said reference voltage source, a non-inverting input receiving a control voltage from the input terminal of said reference voltage source, and an output coupled to the inputs of said switches.

4. A reference voltage source as claimed in claim 2, further comprising feedback means including a third operational amplifier having an inverting input coupled to the output terminal of the reference voltage source, a non-inverting input receiving a control voltage from the input terminal of said reference voltage source, and an output coupled to the inputs of said switches.

* * * * *